US007748182B2

(12) United States Patent
McGee et al.

(10) Patent No.: US 7,748,182 B2
(45) Date of Patent: Jul. 6, 2010

(54) MODULAR WALL SYSTEM INCORPORATING Z-STRIPS

(75) Inventors: Wayne R. McGee, Chesterfield, MO (US); Trace A. Woodrum, Ballwin, MO (US); Robert Weible, St. Louis, MO (US)

(73) Assignee: Porta-Fab Corporation, Chesterfield, MO (US)

( * ) Notice: Subject to any disclaimer, the term of this patent is extended or adjusted under 35 U.S.C. 154(b) by 61 days.

(21) Appl. No.: 11/191,287

(22) Filed: Jul. 28, 2005

(65) Prior Publication Data

US 2007/0022683 A1 Feb. 1, 2007

(51) Int. Cl.
*E04B 2/00* (2006.01)

(52) U.S. Cl. ..... 52/287.1; 52/288.1; 52/235; 52/489.1

(58) Field of Classification Search ..... 52/287.1, 52/288.1, 235, 489.1, 481.2
See application file for complete search history.

(56) References Cited

U.S. PATENT DOCUMENTS 1,555,392 A * 9/1925 Tracy et al. ..... 52/273
2,178,501 A * 10/1939 Staneampiano et al. .... 52/288.1
3,621,635 A * 11/1971 DeLange ..... 52/235
4,067,155 A * 1/1978 Ruff et al. ..... 52/105
4,187,658 A * 2/1980 Reinwall, Jr. ..... 52/489.1
4,315,390 A * 2/1982 Schaafsma ..... 52/287.1
4,910,938 A 3/1990 McGee
5,001,877 A * 3/1991 Edwards ..... 52/288.1
5,256,105 A 10/1993 Austin
5,287,675 A 2/1994 McGee
5,555,689 A * 9/1996 Gilmore ..... 52/489.1
5,632,128 A 5/1997 Agar
6,016,632 A 1/2000 McGee et al.
6,202,377 B1 * 3/2001 Krieger ..... 52/489.1
6,360,510 B1 3/2002 Woodrum et al.
6,951,087 B2 * 10/2005 Weurman ..... 52/489.2

OTHER PUBLICATIONS www.dlawlesshardware.com Jan. 2005 archived webpage.*

* cited by examiner

*Primary Examiner*—Jeanette E Chapman
*Assistant Examiner*—Daniel Kenny
(74) *Attorney, Agent, or Firm*—Armstrong Teasdale LLP

(57) ABSTRACT

A modular wall system is described that includes a plurality of wall panels, a horizontal main bracket having a length; and a plurality of wall panel brackets. Each wall panel bracket is configured for attachment to a corresponding one of the wall panels. Each wall panel bracket is configured to engage the horizontal main bracket so as to hang the corresponding the wall panel while allowing movement of the wall panels in substantially horizontal directions.

19 Claims, 6 Drawing Sheets

MODULAR WALL SYSTEM INCORPORATING Z-STRIPS

BACKGROUND OF THE INVENTION

This invention relates generally to modular wall assemblies, and more specifically, to a modular wall assembly compatible with clean room requirements.

Buildings and rooms within buildings built with modular wall stud assemblies are typically prefabricated and ready for assembly at a building site. Such buildings include in-plant offices, guard houses, food service buildings, control rooms, toll booths, parking lot booths, noise control buildings, clean rooms, and the like. These portable buildings and rooms should be of quality construction, strong and durable. The materials utilized to construct such buildings and rooms should be energy efficient, have good sound control and low maintenance. Other characteristics of such buildings and rooms are relatively easy assembly at the job site and easy disassembly for moving to a different location. Such characteristics are particularly important as in certain applications space requirements, for example, the number and sizes of rooms, are constantly changing. Such modular wall materials should also be economical.

A number of modular wall assemblies are well-known in the art. In these wall assemblies, steel or aluminum wall studs are configured with side recesses for receiving the side edges of pre-fabricated wall panels to form walls. However, these known wall assemblies have been found to be difficult to apply in a clean room configuration. These modular wall assemblies, when constructed, sometimes include gaps, crevices and other surfaces that may be incompatible with a clean room application, particularly a pharmaceutical clean room application. Some inserts have been developed which are inserted into the wall studs in order to smooth out areas where wall panels engage the sides of the studs. However, such inserts add expense, additional parts, and a layer of complexity to the wall assemblies.

BRIEF DESCRIPTION OF THE INVENTION

In one aspect, a modular wall system is provided that comprises a plurality of wall panels, a horizontal main bracket having a length, and a plurality of wall panel brackets. Each wall panel bracket is configured for attachment to a corresponding one of the wall panels. Each wall panel bracket is configured to engage the horizontal main bracket so as to hang the corresponding wall panel while allowing movement of the wall panels in substantially horizontal directions.

In another aspect, a method of building a modular wall is provided. The method comprises hanging at least one main bracket substantially horizontally across a number of substantially vertical studs, configuring each of a plurality of wall panels with at least one wall panel bracket, and moving each wall panel to a desired horizontal position. The wall panel bracket is configured to engage the main bracket and retain a vertical position of the wall panels with respect to the main bracket.

DETAILED DESCRIPTION OF THE INVENTION

Figure 1:
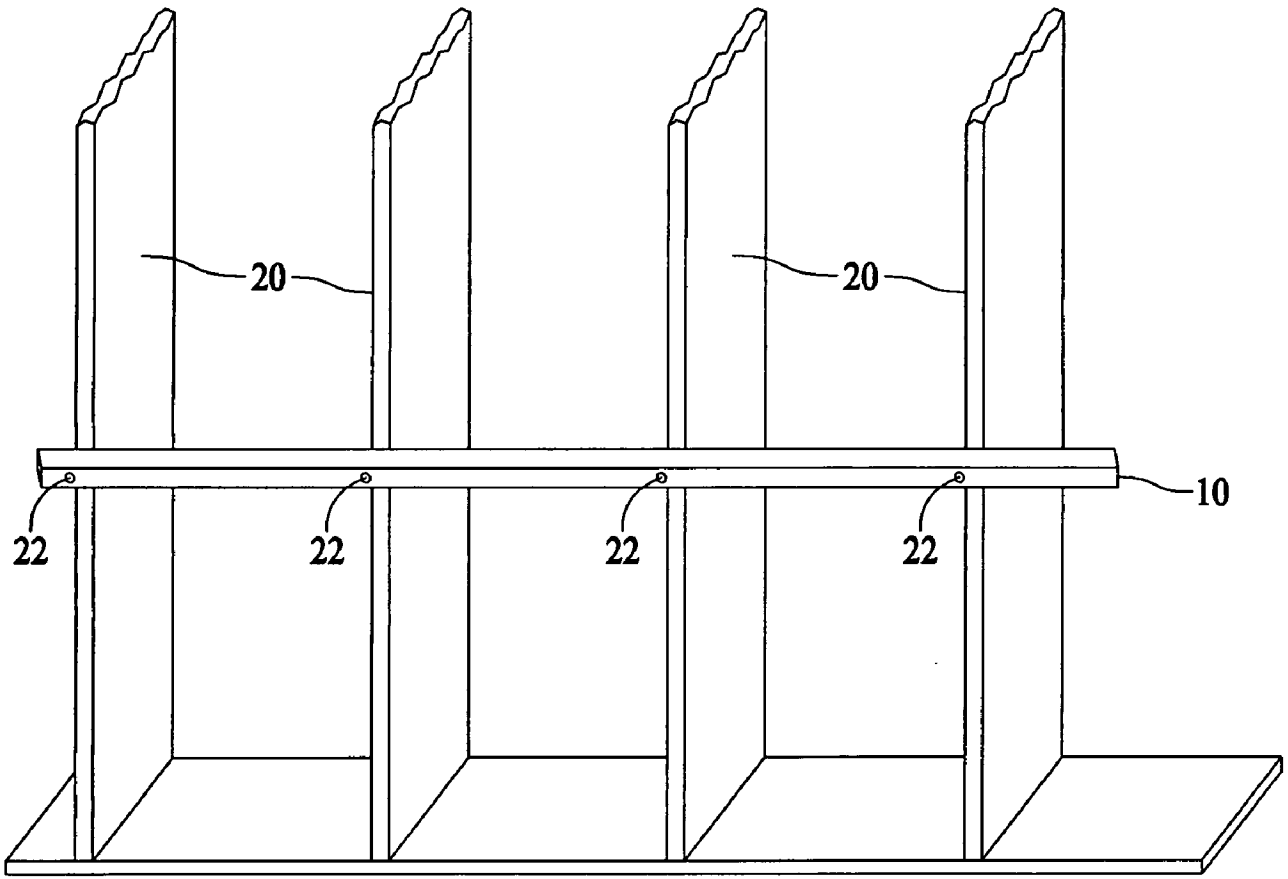
FIG. 1 is a substantially frontal view of a main bracket for a modular wall system.

FIG. 1 is a substantially frontal view of a main bracket 10 that is a part of a modular wall system. Main bracket 10 is utilized in the construction of, for example, a modular clean room of the type known to be desirable in the pharmaceutical industry. More specifically main bracket 10 is configured to mounted substantially horizontally across a plurality of vertical studs 20. In one embodiment, main bracket 10 is configured to be attached to studs 20 using, for example, a plurality of threaded devices 22, for example, screws or lag bolts. In alternative embodiments, where a wall already is in place, main bracket may be installed across a plurality of furrings or furring strips (not shown) that have been attached to the existing wall.

Figure 2:
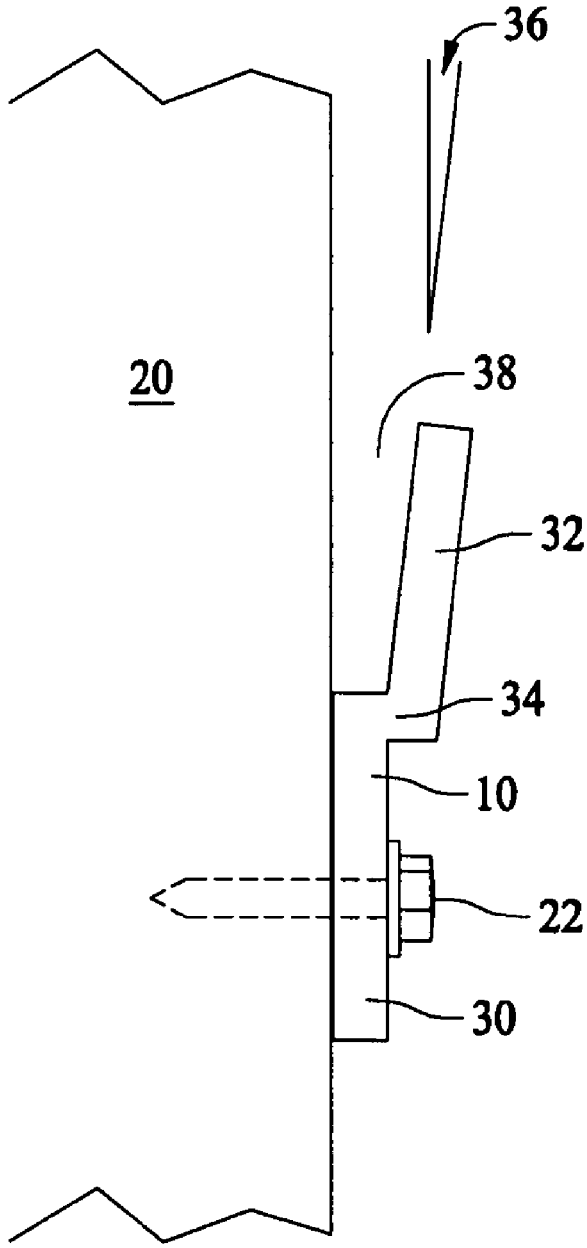
FIG. 2 is a side view of the main bracket shown in FIG. 1.

FIG. 2 is a side view of one embodiment of main bracket 10 shown in FIG. 1. Main bracket 10 includes a stud attachment member 30 configured for substantially flush attachment to a plurality of vertical studs (e.g., stud 20) as further illustrated in FIG. 1. In addition, main bracket 10 includes a panel bracket engaging member 32 that extends from an end 34 of stud attachment member 30 at a slight angle. In the embodiment illustrated, panel bracket engaging member 32 extends fairly vertically from end 34. As such, the angle 36 between stud attachment member 30 and panel bracket engaging member 32 is slight, for example, less than 20 degrees. As further described below, the slight angle of panel bracket engaging member 32 causes a slot 38 to be formed between stud 20 and panel bracket engaging member 32 for insertion of a bracket that is mounted to wall panel (both shown in FIG. 3).

Figure 3:
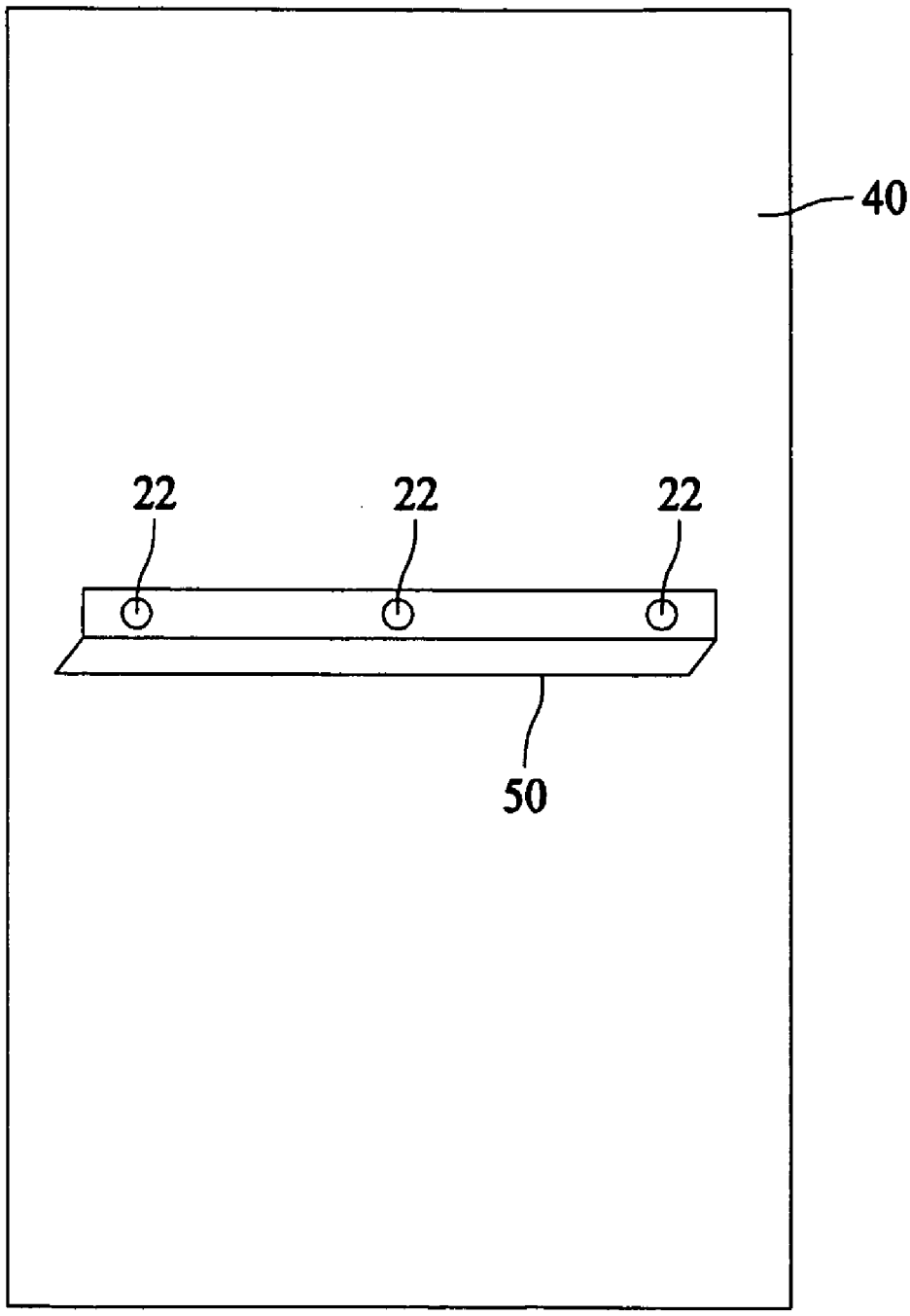
FIG. 3 is a substantial back view of a wall panel having a wall panel bracket mounted thereon.

FIG. 3 is a substantial back view of a wall panel 40 having a wall panel bracket 50 mounted thereon. Wall panel 40 is typical of wall panels utilized in the construction of modular walls, and in one specific embodiment, is constructed from materials, for example, PVC coated steel that are compatible with the construction of walls for pharmaceutical type clean rooms. In a particular embodiment, a common size for such panels are about four feet by about eight feet. Wall panel bracket 50 has a cross-section similar to main bracket 10, as further described below, and is configured to be attached to wall panel 40 using, for example, a plurality of threaded devices 22, for example, screws or lag bolts. In alternative embodiments, glues or other adhesives are utilized to attach a wall panel bracket 50 to a wall panel 40.

Figure 4:
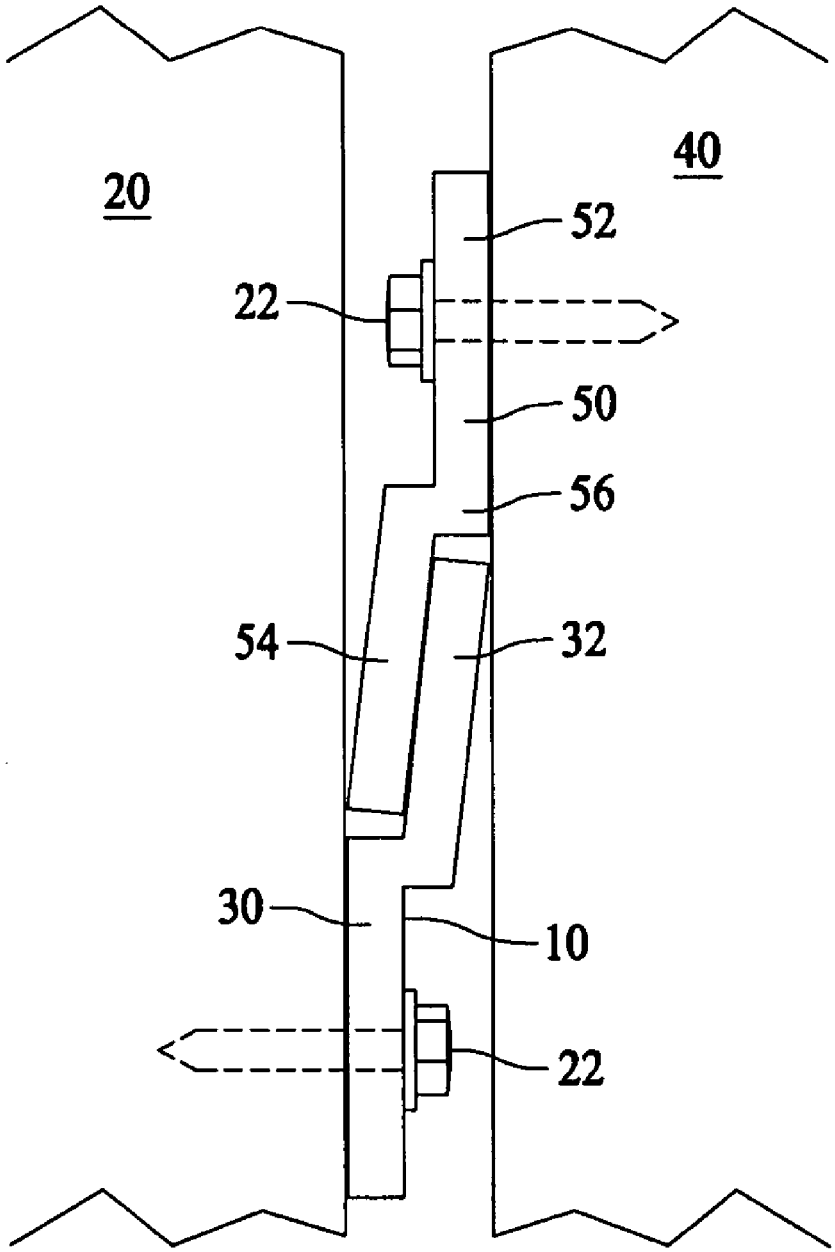
FIG. 4 is a side view illustrating an engagement between the main bracket of FIG. 2 and the wall panel bracket of FIG. 3.

FIG. 4 is a side view illustrating an engagement between main bracket 10 (shown in FIG. 2) and wall panel bracket 50. Specifically, wall panel bracket 50 includes a panel attachment member 52 configured for substantially flush attachment to wall panel 40. In addition, wall panel bracket 50 includes main bracket engaging member 54 that extends from an end 56 of panel attachment member 52 at a slight angle. In the embodiment illustrated, main bracket engaging member 54 extends fairly vertically from end 56. As such, an angle between panel attachment member 52 and main bracket engaging member 54 is slight, for example, less than 20 degrees, or approximately the same as angle 36 (shown in FIG. 2).

As shown in FIG. 4, to construct a wall, main bracket engaging member 54 for each wall panel 40 is inserted between panel bracket engaging member 32 and the corresponding studs 20. The described configuration allows a user to set multiple wall panels 40 onto a main bracket 10. Another advantage to the configuration is that it provides for lateral movement of wall panels 40 such that an insert (not shown) or caulking material may be placed between two wall panels 40 to provide the substantially smooth wall surface desired in a clean room environment. In particular applications, for example, depending on a desired height for a wall, multiple main brackets 10 may be mounted on studs 20, one above another. On the corresponding wall panels 40, multiple wall panel brackets 50 are mounted such that each main bracket 10/wall panel bracket 50 pair engage one another.

Figure 5:
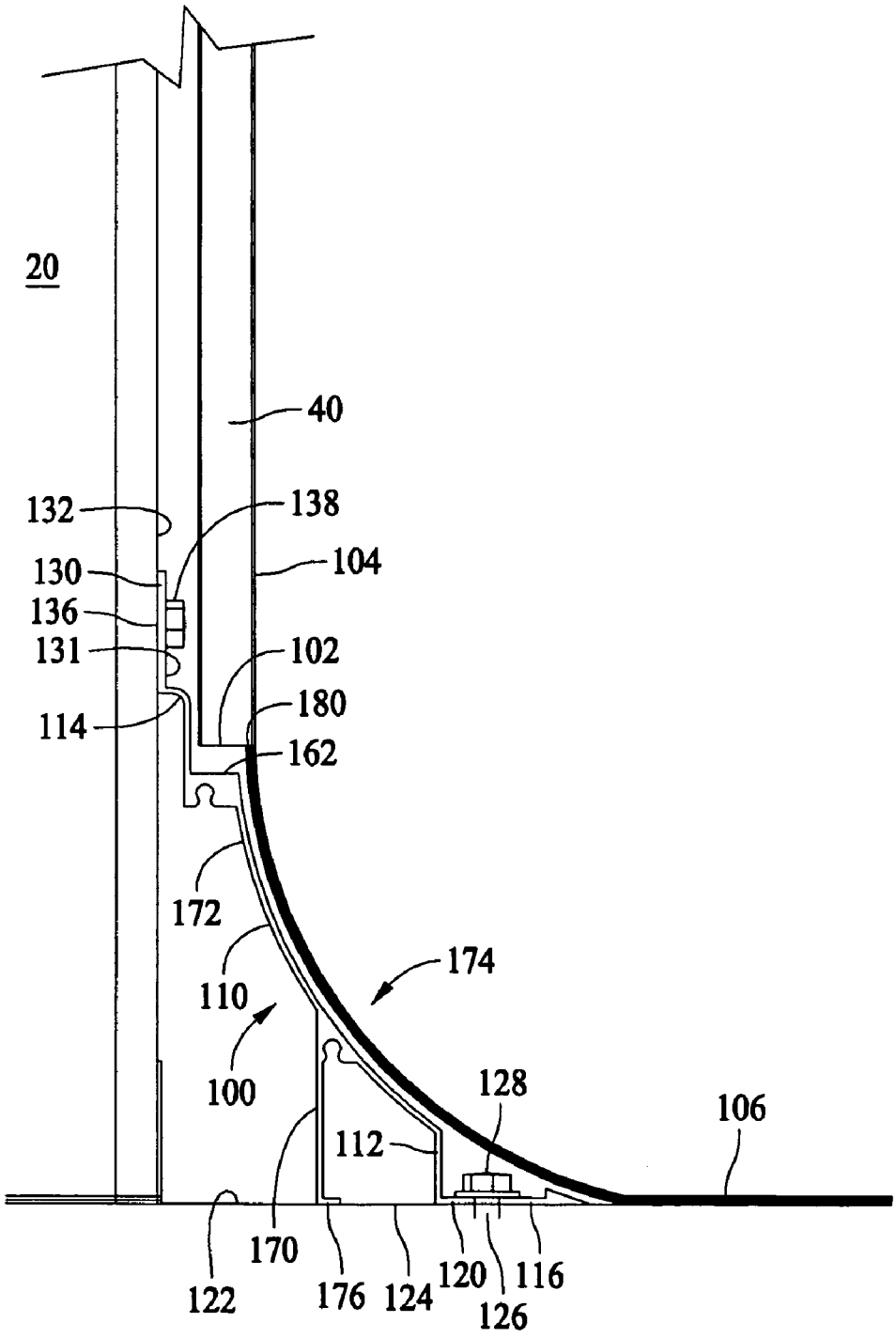
FIG. 5 is a side view of a floor bracket configured to engage a bottom of the wall panel of FIG. 3 including flooring material installed thereon.

FIG. 5 is a side view of a floor bracket 100 configured to engage and support a bottom 102 of wall panel 40 (also shown in FIG. 3). In pharmaceutical clean room applications, smooth, sloping surfaces are desired in order to maintain the cleanliness of such a room. Particularly, cornered and angled surfaces appear to be more prone to harboring bacteria, dirt, germs, and the like since it is difficult to clean in such areas. As such, smooth transitions between walls and ceilings and walls and floor are thought to provide easier access for cleaning.

To provide the desired smooth surface, at least for the junction of the wall 104 and the flooring material 106, floor bracket 100 includes a center portion 110 having a radius. Extending from center portion 110 is a floor engaging member 112 and a wall panel engaging member 114. Floor engaging member 112 includes a flange 116 that includes a surface 120 configured to be substantially flush with a surface 122 of a sub-floor 124. Floor bracket 100 may be of a length similar to main bracket 10 (shown in FIG. 1). As such, floor engaging member 112, and particularly flange 116, is configured with a number of openings 126 formed therethrough, through which a fastening device 128, such as a lag bolt or other threaded device, is inserted for engagement with sub-floor 124.

Wall panel engaging member 114 is similar to floor engaging member 112 in that wall panel engaging member 114 includes a flange 130 having a surface 131 configured to be substantially flush with a surface 132 of studs 20 is included. Flange 130 of wall panel engaging member 114 is configured with one or more openings 136 formed therein through which a fastening device 138, such as a lag bolt or other threaded device, is inserted for engagement with stud 20. Wall panel engaging member 114 further includes a substantially horizontal wall panel engaging surface 162 on which bottom 102 of wall panel 40 rests when wall panel 40 is installed.

A center support 170 extends substantially vertically from a back side 172 of a center area 174 of center portion 110. Center support 170 includes a foot 176 that engages surface 122 of sub-floor 124. Center support 170 and foot 176 provide additional strength to floor bracket 100 as can be ascertained from FIG. 5.

In one embodiment, when floor bracket 100 and wall panels 40 have been installed, floor 106 is installed to extend in an arc such that an end 180 of flooring material 106 is adjacent bottom 102 of wall panels 40. In one embodiment, floor bracket 100 and more specifically center portion 110 is configured to be recessed, for example, about one-eighth inch so that flooring material 106 and wall panel 40 are substantially flush. As such, the configuration of floor bracket results in an edge 180 of floor 106 butting against bottom 102 of wall panel 40. The combination of floor bracket 100, flooring material 106, and wall panel 40 therefore provide a smooth, and easily cleanable surface at the transition from wall panel 40 to floor 106. To provide additional smoothness, caulk or bonding material (not shown) may be utilized at the junction of wall panel 40 and flooring material 106.

Figure 6:
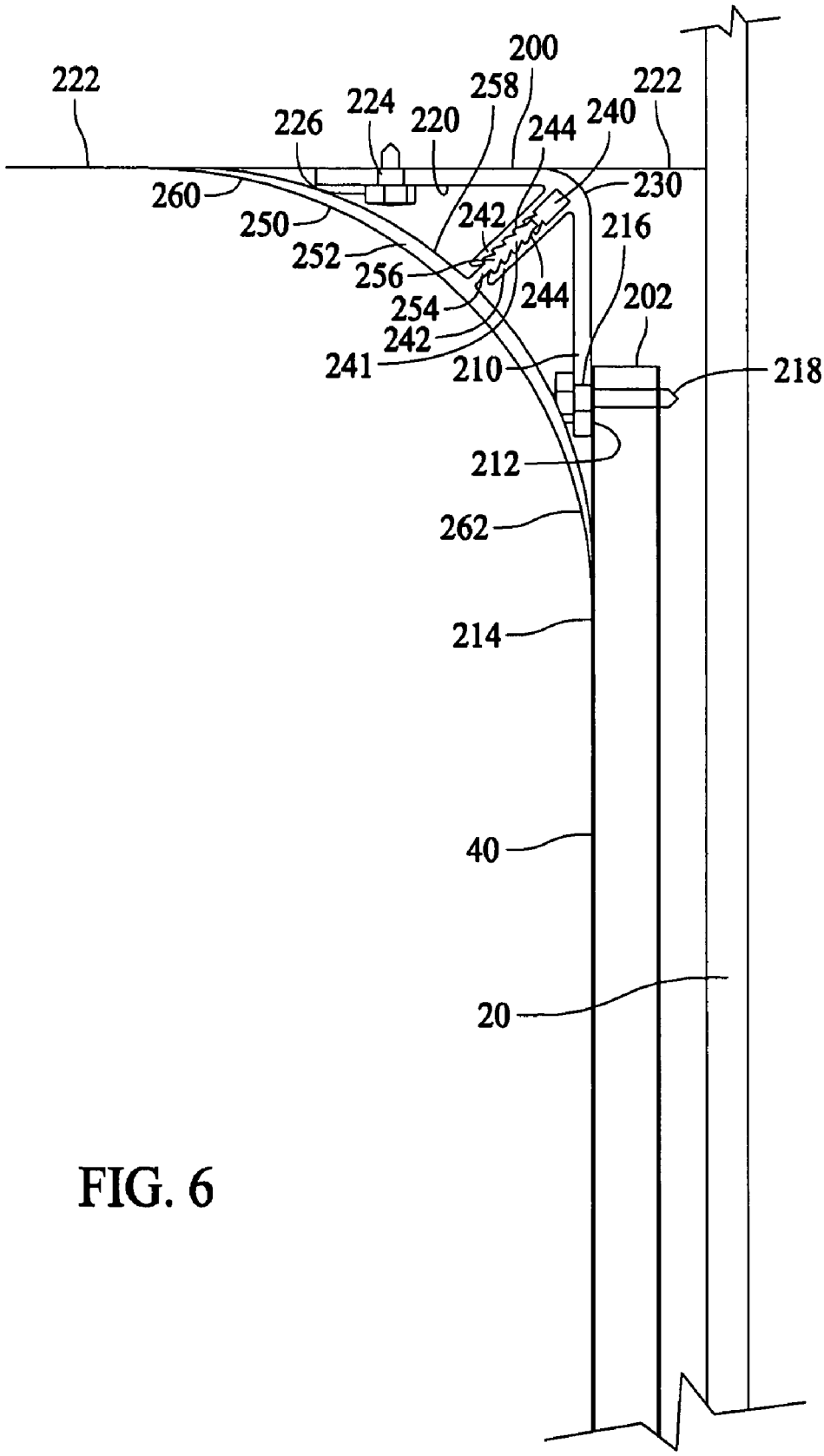
FIG. 6 is a side view of a ceiling bracket configured to engage a top of the wall panel of FIG. 3 and a ceiling cove molding attached thereto.

FIG. 6 is a side view of a ceiling bracket 200 configured to engage a top portion 202 of wall panel 40. Ceiling bracket 200 includes a flange 210 having a surface 212 configured to be substantially flush with a surface 214 of wall panels 40. Flange 210 of ceiling bracket 200 is configured with one or more openings 216 formed therein through which a fastening device 218, such as a lag bolt or other threaded device, is inserted for engagement with wall panel 40. Ceiling bracket 200 includes a ceiling flange 220 which attaches to a ceiling 222. Flange 220 of ceiling bracket 200 is configured with one or more openings 224 formed therein through which a fastening device 226, such as a lag bolt or other threaded device, is inserted for engagement with ceiling 222. As such, ceiling bracket 200 forms a substantial right angle, though an angle portion 230 is smoothly curved, at least in the illustrated embodiment.

Extending from angle portion 230 and into the substantial right angle is a cove engaging member 240. Cove engaging member 240 includes a substantially rectangular slot 241 as member 240 is fabricated from two substantially perpendicular toothed members 242 having teeth 244 which face the opposing toothed member 242.

As illustrated, ceiling cove 250 is configured to provide a smooth transition from wall panel 40 to ceiling 222. In one embodiment, ceiling cove 250 is semi flexible and when installed provides a radius member 252 from wall panel 40 to ceiling 222. More specifically, ceiling cove 250 includes a ceiling bracket engaging member 254 having teeth 256 on each side which extends substantially perpendicularly from a back 258 of ceiling cove 250. Teeth 256 are configured to engage teeth 244 of ceiling bracket 200 as ceiling cove 250 is installed.

The engagement of teeth 256 with teeth 244 is a result of an insertion force applied by an installer to ceiling cove 250 and the force causes a flexure of ceiling cove 250. While semi-flexible, the force also causes ceiling cove 250 attain the desired radius shape. Specifically, a ceiling engaging portion 260 is pressed against ceiling 252 and a wall engaging portion 262 is set in place against wall panel 40. To increase smoothness and reduce an amount of surfaces where bacteria and germs and the like can exist, the transitions between ceiling cove 250 and ceiling 222 may be caulked or bonded, as can the transition between ceiling cove 250 and wall panels 40.

The above described embodiments allow for the construction of temporary walls that provide the desired characteristics of a clean room, for example, a clean room utilized in the production of pharmaceuticals. More specifically, the modular wall system described herein provides a substantially smooth wall surface, and substantially smooth transitions from the wall to both the floor and ceiling, which are typically desired in certain clean room applications. Furthermore, the modular wall system described herein allows for the simple construction of any size room having the above described properties which are desirable for use in clean rooms and which also provide a sturdy wall construction.

While the invention has been described in terms of various specific embodiments, those skilled in the art will recognize that the invention can be practiced with modification within the spirit and scope of the claims.

What is claimed is:

1. A modular wall and flooring system for erecting a temporary pharmaceutical clean room within a wall frame and a subfloor, said system comprising:

a wall assembly comprising:

a plurality of wall brackets; and a plurality of wall panels, said plurality of wall panels removably mountable on the wall frame via said plurality of wall brackets to form a substantially smooth wall surface; and a floor assembly comprising:

a plurality of floor brackets, wherein each bracket of said plurality of floor brackets comprises a single-piece body, and at least one flange extending from said single-piece body;

a plurality of fastening devices; and a flooring material comprising a top surface, said at least one flange operable for fastening said body to at least one of the subfloor and the wall frame using said plurality of fastening devices, said body comprising an arcuate surface for supporting a portion of said flooring material, said arcuate surface positioned and oriented such that a portion of said top surface of said flooring material, when said flooring material is placed across said arcuate surface of said body, is substantially aligned and flush with a portion of the wall surface of said wall assembly such that adjacent portions of the wall surface and said top surface of said flooring material form a substantially smooth surface, said at least one flange accessible for removal of said floor bracket upon removal of at least one of said flooring material and at least one wall panel of said plurality of wall panels.

2. A modular wall and flooring system in accordance with claim 1, wherein said body comprises a wall panel engaging surface adjacent said arcuate surface, said wall panel engaging surface oriented to be substantially parallel to a bottom surface of said at least one wall panel of said plurality of wall panels when said floor bracket is fastened to at least one of the subfloor and the wall frame and when said at least one wall panel of said plurality of wall panels are mounted on the wall frame.

3. A modular wall and flooring system in accordance with claim 1, wherein said body comprises a top side, a back side, and a center support extending from said back side, said center support configured to engage the subfloor to facilitate supporting said flooring material.

4. A modular wall and flooring system in accordance with claim 1, wherein said floor bracket is shaped to define a void between said body and an intersection of the subfloor and the wall frame when said floor bracket is fastened to at least one of the subfloor and the wall frame.

5. A modular wall and flooring system in accordance with claim 1, wherein said body comprises a subfloor engaging flange comprising a surface oriented to be substantially adjacent a surface of the subfloor when said floor bracket is fastened to the subfloor, said subfloor engaging flange comprising an aperture sized to receive one fastening device of said plurality of fastening devices, said floor bracket shaped to define a void between said subfloor engaging flange and said flooring material such that a head of said one fastening device of said plurality of fastening devices is disposed within the void when said floor bracket is fastened to the subfloor and when said flooring material is laid atop said floor bracket.

6. A modular wall and flooring system in accordance with claim 1, wherein said body comprises a wall frame engaging flange comprising a surface oriented to be substantially adjacent a surface of the wall frame when said floor bracket is fastened to the wall frame, said wall frame engaging flange comprising an aperture sized to receive one fastening device of said plurality of fastening devices, said floor bracket shaped to define a void between said wall frame engaging flange and said at least one wall panel of said plurality of wall panels such that a head of said one fastening device of said plurality of fastening devices is disposed within the void when said floor bracket is fastened to the wall frame and when said at least one wall panel of said plurality of wall panels is mounted on the wall frame.

7. A modular wall and flooring system in accordance with claim 1, wherein said plurality of wall brackets comprises:

a horizontal main bracket that is z-shaped and is configured to couple to the wall frame such that a first slot is defined by at least a portion of said main bracket and the wall frame; and a plurality of wall panel brackets, wherein each wall panel bracket of said plurality of wall panel brackets is z-shaped and is configured to couple to said at least one wall panel of said plurality of wall panels such that a second slot is defined by said wall panel bracket and said one at least one wall panel, each wall panel bracket of said plurality of wall panel brackets configured to engage said horizontal main bracket so as to mount said at least one wall panel on the wall frame such that said at least one wall panel is moveable in substantially horizontal directions along the first slot and the second slot.

8. A modular wall and flooring system in accordance with claim 1, further comprising:

a ceiling bracket mountable at an intersection of a ceiling and said at least one wall panel; and a ceiling cove configured to be coupled to said ceiling bracket to provide a substantially smooth transition between said ceiling cove, said at least one wall panel, and the ceiling.

9. A modular wall and flooring system in accordance with claim 5, wherein said body comprises a wall frame engaging flange comprising a surface oriented to be substantially adjacent a surface of the wall frame when said floor bracket is fastened to the wall frame, said arcuate surface extending from said wall frame engaging flange to said subfloor engaging flange, said arcuate surface formed from a single, continuous material.

10. A modular wall and flooring system in accordance with claim 8, wherein said ceiling bracket comprises a toothed cove engaging member forming a slot and substantially bisecting a substantially right angle formed by said ceiling bracket, said ceiling cove comprising a toothed ceiling bracket engaging member configured to engage said toothed cove engaging member within the slot to facilitate coupling said ceiling cove to said ceiling bracket.

11. A floor bracket for a modular wall and flooring system, said floor bracket comprising:

a single-piece body comprising an arcuate surface configured to be mounted beneath a flooring material such that, when the flooring material is placed across said body, the flooring material is substantially aligned and flush with an exterior surface of the modular wall, said body further comprising a planar wall panel engaging surface adjacent said arcuate surface, said wall panel engaging surface oriented to be substantially parallel to a bottom surface of the wall panel when said floor bracket is fastened to at least one of the subfloor and the wall frame and when the wall panel is mounted on the wall frame; and at least one flange comprising at least one opening therethrough for fastening said floor bracket to at least one of a subfloor and a wall frame utilizing at least one fastener, said at least one flange extending from said body such that said at least one flange is accessible for removal of said at least one fastener and said floor bracket upon removal of at least one of the flooring material and a wall panel of the modular wall.

12. A floor bracket in accordance with claim 11, wherein said body comprises a top side, a back side, and a center support extending from said back side, said center support configured to engage the subfloor to facilitate supporting the flooring material thereon.

13. A floor bracket in accordance with claim 11, wherein said floor bracket is shaped to define a void between said body and an intersection of the subfloor and the wall frame when said floor bracket is fastened to at least one of the subfloor and the wall frame.

14. A floor bracket in accordance with claim 11, wherein said at least one flange comprises a subfloor engaging flange comprising a surface oriented to be substantially adjacent a surface of the subfloor when said floor bracket is fastened to the subfloor, said subfloor engaging flange comprising an aperture sized to receive one fastener of said at least one fastener.

15. A floor bracket in accordance with claim 11, wherein said at least one flange comprises a wall frame engaging flange comprising a surface oriented to be substantially adjacent a surface of the wall frame when said floor bracket is fastened to the wall frame, said wall frame engaging flange comprising an aperture sized to receive one fastener of said at least one fastener.

16. A floor bracket in accordance with claim 11, wherein said at least one flange comprises:

a subfloor engaging flange comprising a surface oriented to be substantially adjacent a surface of the subfloor when said floor bracket is fastened to the subfloor, said subfloor engaging flange comprising an aperture sized to receive a first fastener of said at least one fastener; and a wall frame engaging flange comprising a surface oriented to be substantially adjacent a surface of the wall frame when said floor bracket is fastened to the wall frame, said wall frame engaging flange comprising an aperture sized to receive a second fastener of said at least one fastener.

17. A floor bracket in accordance with claim 16, wherein said floor bracket is shaped to define a void between said subfloor engaging flange and the flooring material such that a head of said one fastener of said at least one fastener is disposed within the void when said floor bracket is fastened to the subfloor and when the flooring material is laid atop said floor bracket.

18. A floor bracket in accordance with claim 16, wherein said floor bracket is shaped to define a void between said wall frame engaging flange and the wall panel such that a head of said one fastener of said at least one fastener is disposed within the void when said floor bracket is fastened to the wall frame and when the wall panel is mounted on the wall frame.

19. A floor bracket in accordance with claim 16, wherein said arcuate surface extends from said wall frame engaging flange to said subfloor engaging flange, said arcuate surface formed from a single, continuous material.

* * * * *